US007876343B2

(12) United States Patent
Yamade

(10) Patent No.: US 7,876,343 B2
(45) Date of Patent: Jan. 25, 2011

(54) THERMAL PRINT HEAD AND METHOD FOR MANUFACTURING SAME

(75) Inventor: Takumi Yamade, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 572 days.

(21) Appl. No.: 11/921,687

(22) PCT Filed: Jun. 6, 2006

(86) PCT No.: PCT/JP2006/311296

§ 371 (c)(1),
(2), (4) Date: Dec. 6, 2007

(87) PCT Pub. No.: WO2006/132227

PCT Pub. Date: Dec. 14, 2006

(65) Prior Publication Data

US 2009/0207229 A1 Aug. 20, 2009

(30) Foreign Application Priority Data

Jun. 7, 2005 (JP) ..... 2005-166346

(51) Int. Cl.
*B41J 2/335* (2006.01)

(52) U.S. Cl. ..... 347/203

(58) Field of Classification Search ..... None
See application file for complete search history.

(56) References Cited

U.S. PATENT DOCUMENTS 4,786,916 A 11/1988 Kato
5,072,236 A 12/1991 Tatsumi et al.
5,847,744 A 12/1998 Hoki et al.
6,330,013 B1 12/2001 Kashiwaya et al.

FOREIGN PATENT DOCUMENTS

| | | |
|---|---|---|
| JP | 8-207335 | 8/1996 |
| JP | 2578235 | 11/1996 |
| JP | 11-91148 | 4/1999 |
| JP | 2000-343738 | 12/2000 |
| JP | 2004-114633 | 4/2004 |
| JP | 2004-291513 | 10/2004 |
| JP | 2004291513 A * | 10/2004 |

OTHER PUBLICATIONS

International Search Report from the corresponding PCT/JP2006/311296, Mailed Jun. 27, 2006.

* cited by examiner

*Primary Examiner*—Manish S Shah
*Assistant Examiner*—Alexander C Witkowski
(74) *Attorney, Agent, or Firm*—Hamre, Schumann, Mueller & Larson, P.C.

(57) ABSTRACT

A thermal printhead A includes a glaze layer 2 formed on an insulating substrate 1, a resistor layer 3 formed on the glaze layer, a conductor layer 4 formed so that part of the resistor layer is exposed to serve as a heating portion 3*c* and a protective film 5 formed to cover the conductor layer 4 and the heating portion 3*c*. The protective film 5 includes a lower first protective layer 5*a*, and an upper second protective layer 5*b* overlapping the first protective layer 5*a* and serving as the outermost layer. The first protective layer 5*a* has a hardness of 500 to 800 Hk and a thickness of 1 to 2 μm. The second protective layer 5*b* has a hardness of 1000 to 2000 Hk and a thickness of 5 to 8 μm.

7 Claims, 2 Drawing Sheets

THERMAL PRINT HEAD AND METHOD FOR MANUFACTURING SAME

TECHNICAL FIELD

The present invention relates to a thermal printhead used for thermosensitive recording or thermal transfer recording by a barcode printer or a dye sublimation photo color printer, for example. The invention particularly relates to a thin-film thermal printhead.

BACKGROUND ART

A typical thin-film thermal printhead, disclosed in e.g. the following Patent Document 1, has a structure as shown in FIGS. 3 and 4 of the present application. The thin-film thermal printhead B shown in the figures has a lamination structure including an insulating substrate 101, a heat-retaining glaze layer 102 formed on the insulating substrate, a resistor layer 103 formed as a thin film on the heat-retaining glaze layer 102 by e.g. sputtering, a conductor layer 104 formed similarly as a thin film on the resistor layer 103, and a protective film 105 covering the resistor layer 103 and the conductor layer 104. In the example shown in FIG. 4, the heat-retaining glaze layer 102 includes a gently bulging portion 102*c*. The resistor layer 103 extends continuously from one base to the opposite base of the bulging portion 102*c* over the top of the bulging portion, but is divided at regular intervals in the longitudinal direction of the bulging portion 102*c* (FIG. 3). The conductor layer 104 is partially removed at the top of the bulging portion 102*c*. The conductor layer includes a plurality of individual electrodes 104*a* extending from the bulging portion 102*c* in one direction and electrically connected to the output pad of a non-illustrated driver IC, and a common electrode 104*b* provided with a plurality of comb-teeth 104*c* extending from the bulging portion 102*c* in the opposite direction from the individual electrodes 104*a*.

When voltage is applied between each of the individual electrodes 104*a* and the common electrode 104*b*, current flows through the portions 103*c* (heating dots) of the resistor layer 103 which are located on the top of the bulging portion 102*c* to generate Joule heat. The heating dots 103*c* are pressed against a printing medium via the protective film 105, whereby thermosensitive printing is performed.

The protective layer 105 may be formed using a hard material such as $SiO_2$ by a thin film formation technique such as sputtering to have a thickness of not more than about 5 μm, for example. The protective layer 105 is a portion to rub against the printing medium such as thermal recording paper or an ink ribbon in printing, and hence, needs to be abrasion-resistant. Further, the protective layer 105 serves to prevent the corrosion of the resistor layer 103 or the conductor layer 104 by preventing moisture contained in the atmosphere or $Cl^-$ or $Na^+$ ions or the like contained in the printing medium from coming into contact with these layers.

However, in the case where the thickness of the protective layer 105 is not more than 5 μm, when foreign matter such as dust in the printer enters the space between the thermal printhead B and the printing medium (not shown), the protective layer 105 is peeled off by the foreign matter to partially expose the resistor layer 103 or the conductor layer 104. In this case, the resistance of the resistor layer 103 is largely changed due to oxidation or corrosion, whereby the print quality is considerably deteriorated. Further, in forming the protective layer 105 by sputtering, film formation defects such as a crack starting from the stepped portion 104*d* between the resistor layer 103 and the conductor layer 104 or a pinhole caused by foreign matter adhering to the resistor layer 103 or the conductor layer 104 are likely to occur. As a result, the $Cl^-$ or $Na^+$ ions or the like infiltrate to corrode the resistor layer 103 and the conductor layer 104, so that the resistance of the conductor layer 103 is largely changed in a relatively short period of time.

Patent Document 1: JP-A-H08-207335

A method to solve the above-described problems is to form the protective layer by bias sputtering. By employing the bias sputtering, a protective layer having few film formation defects and a high sealing performance can be obtained. However, the protective layer 105 formed by bias sputtering has a large stress therein, and hence, is likely to peel off from the conductor layer 104 due to the friction with the printing medium.

DISCLOSURE OF THE INVENTION

An object of the present invention, which has been proposed under the above-described circumstances, is to provide a thermal printhead which is resistant to corrosion and defects and has a high reliability, and to provide a method for manufacturing such a thermal printhead.

According to a first aspect of the present invention, there is provided a thermal printhead comprising a glaze layer formed on an insulating substrate, a resistor layer formed on the glaze layer, a conductor layer formed on the resistor layer so that part of the resistor layer is exposed to serve as a heating portion, and a protective film formed to cover the conductor layer and the heating portion. The protective film comprises a lower first protective layer, and an upper second protective layer overlapping the first protective layer. The upper second protective layer is the outermost layer. The first protective layer has a hardness of 500 to 800 Hk and a thickness of 1 to 2 μm. The second protective layer has a hardness of 1000 to 2000 Hk and a thickness of 5 to 8 μm.

Preferably, the resistor layer has a thickness of 500 to 1000 Å, whereas the conductor layer has a thickness of 0.6 to 1 μm.

Preferably, the glaze layer includes a bulging portion, and the heating portion is positioned on the bulging portion.

Preferably, the first protective layer is mainly composed of silicon oxide, whereas the second protective layer is mainly composed of Si—Al—O—N, SiC or SiN.

In the thermal printhead according to the first aspect of the present invention, the protective film has a two-layer structure. The upper second protective layer, which is the outermost layer to directly rub against a recording medium, has a high hardness of 1000 to 2000 Hk and is highly resistant to abrasion by the recording medium or foreign matter. Under the upper second protective layer, a first protective layer is provided which has a hardness of e.g. 500 to 800 Hk which is lower than that of the upper second protective layer. Thus, even when the upper second protective layer, which is harder, has a considerable thickness, the internal stress of the upper second protective layer is alleviated, so that the upper second protective layer is effectively prevented from being easily peeled off due to e.g. the impact by its contact with foreign matter. Further, since the protective film as a whole has a thickness of not less than 6 μm, film formation defects or pinholes are unlikely to be formed. In this way, the protective film of this thermal printhead is highly resistant to abrasion and unlikely to peel off. Further, the protective film has a structure which prevents film formation detects and pinholes from being formed in the protective film forming process. As a result, rapid corrosion of the conductor layer or the resistor layer caused by the peeling of the protective film, film formation defects or pinholes, and the resulting change in resistance is prevented. Accordingly, deterioration of the print quality due to such change in resistance is effectively prevented.

According to a second aspect of the present invention, there is provided a method for manufacturing a thermal printhead. The method comprises the steps of forming a glaze layer on an insulating substrate, forming a resistor layer on the glaze layer by sputtering, forming a conductor layer on the resistor layer so that part of the resistor layer is exposed to serve as a heating portion, forming a first protective layer to cover the conductor layer and the heating portion by non-bias sputtering, and forming a second protective layer as an outermost layer on the first protective layer by bias sputtering.

Preferably, in the first protective layer formation step, the first protective layer is formed to have a hardness of 500 to 800 Hk and a thickness of 1 to 2 μm, whereas, in the second protective layer formation step, the second protective layer is formed to have a hardness of 1000 to 2000 Hk and a thickness of 5 to 8 μm.

Preferably, in the resistor layer formation step, the resistor layer is formed to have a thickness of 500 to 1000 Å, whereas, in the conductor layer formation step, the conductor layer is formed to have a thickness of 0.6 to 1 μm.

Generally, bias sputtering makes the resulting film much denser and harder than non-bias sputtering does. Thus, by forming a lower first protective layer by non-bias sputtering and then forming an upper second protective layer by bias sputtering, in combination with the use of properly selected materials, the upper second protective layer has an advantageously high hardness of 1000 to 2000 Hk, and in addition, it is possible to prevent the formation of pinholes. Further, when a second protective layer is to be formed by bias sputtering on the lower first protective layer, plasma ions strike the negatively charged surface of the lower first protective layer. As a result, the surface of the lower first protective layer is slightly etched away, thereby removing undesirable foreign substances on the surface. This enhances the adhesion of the upper second protective layer to the lower first protective layer, thereby preventing the peeling of the second protective layer. Further, since floating foreign substances are often negatively charged by the ion sheath near the target, they are unlikely to adhere to the lower first protective layer nor to the upper second protective layer to be laminated on the first one. This also prevents the occurrence of defects in forming the protective layer.

Other features and advantages of the present invention will become more apparent from the detailed description given below with reference to the accompanying drawings.

BEST MODE FOR CARRYING OUT THE INVENTION

Preferred embodiments of the present invention will be described below with reference to the accompanying drawings.

Figure 1:
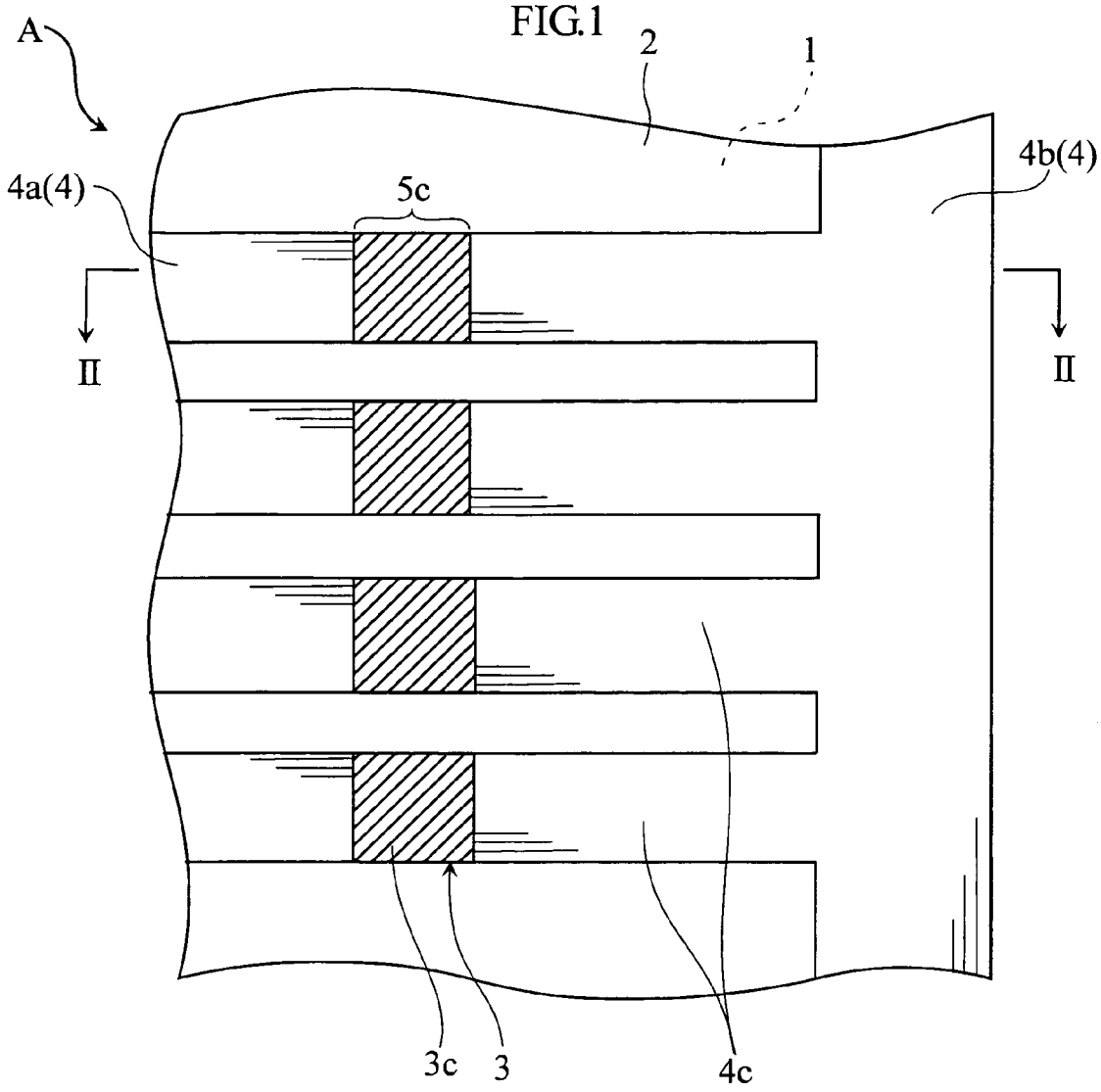
FIG. 1 is a plan view showing a part of a thermal printhead according to a first embodiment of the present invention.
Figure 2:
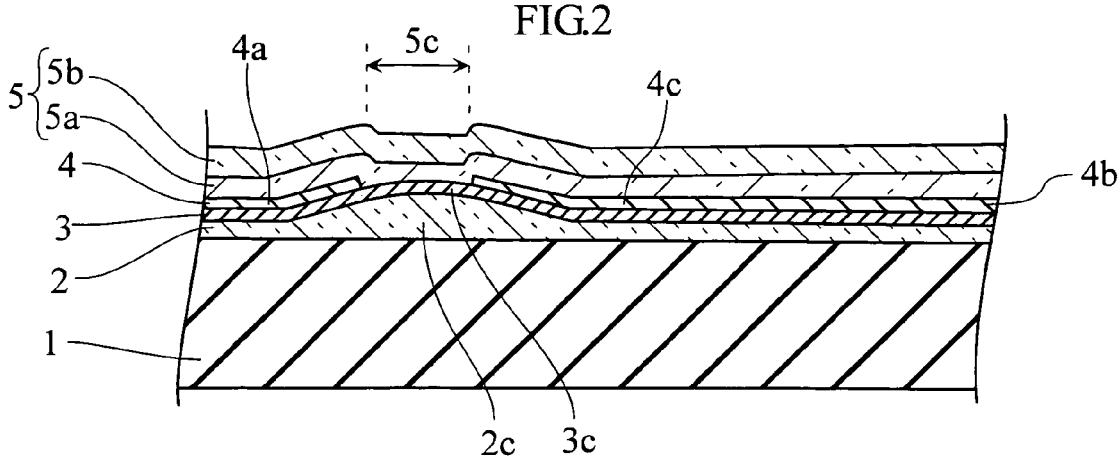
FIG. 2 is a sectional view taken along lines II-II in FIG. 1.
Figure 3:
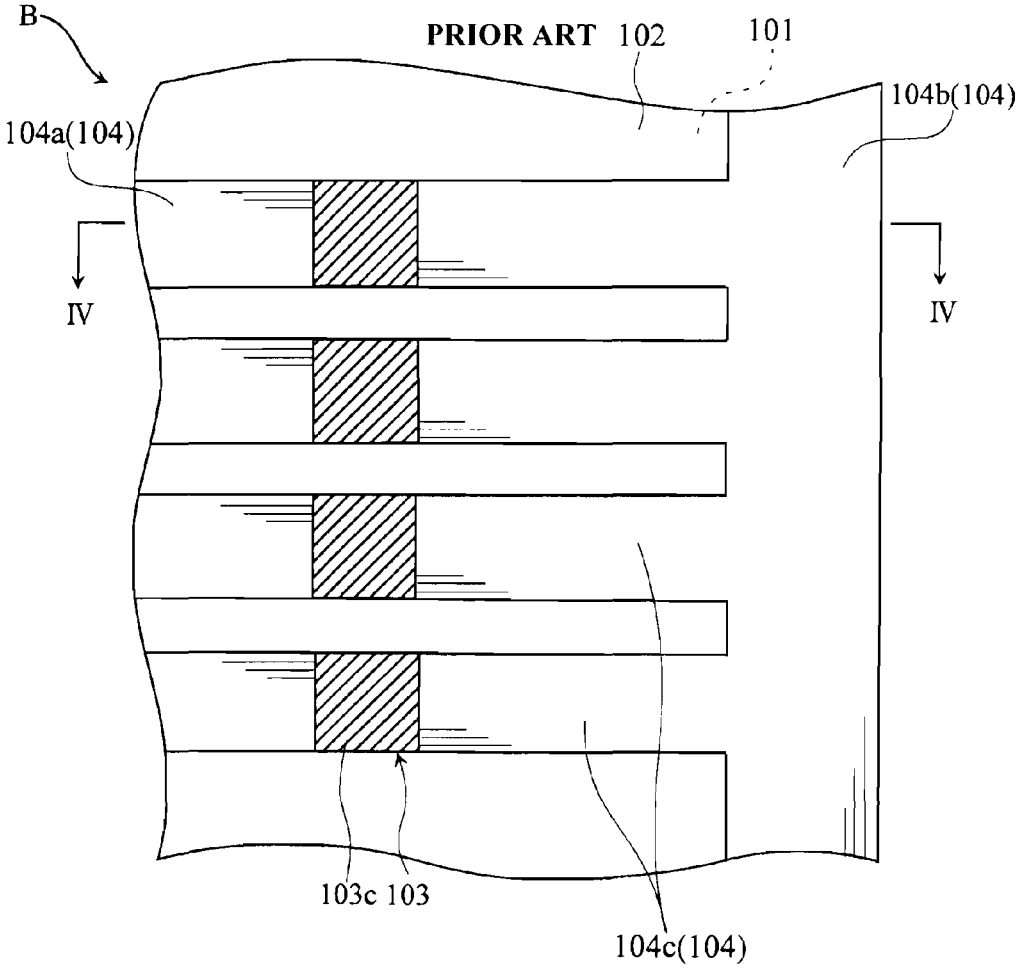
FIG.3 PRIOR ART
FIG. 3 is a plan view showing a part of a conventional thermal head.
Figure 4:
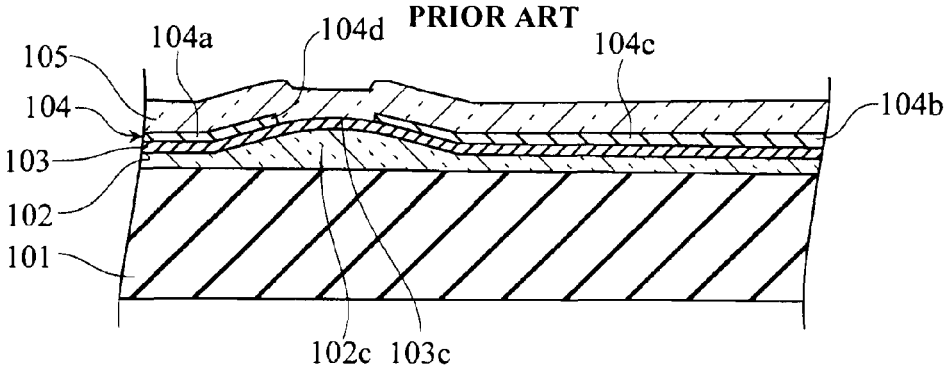
FIG.4 PRIOR ART
FIG. 4 is a sectional view taken along lines IV-IV in FIG. 3.

FIGS. 1 and 2 show a thermal printhead A according to an embodiment of the present invention. In FIG. 2, the thickness of each structural element of the thermal printhead A is exaggerated. Although the entirety of the thermal printhead A is not illustrated in FIG. 1, the thermal printhead A is in the form of a vertically elongated strip.

As shown in FIG. 2, the thermal printhead includes a substrate 1, a heat-retaining glaze layer 2, a resistor layer 3, a conductor layer 4, a lower first protective layer 5*a* and an upper second protective layer 5*b*.

The substrate 1 is made of an insulating material such as an alumina ceramic material. The heat-retaining glaze layer 2, mainly composed of e.g. glass, is formed on the substrate 1 by utilizing a printing method. The glaze layer 2 includes a gently bulging portion 2*c* extending continuously in the longitudinal direction of the substrate. The resistor layer 3 is formed on the heat-retaining glaze layer 2 and has a thickness of 500 to 1000 Å. The conductor layer 4 mainly composed of aluminum Al is formed on the resistor layer and has a thickness of 0.6 to 1 μm. The resistor layer 3 and the conductor layer 4 are formed by a film formation technique such as sputtering, so that these layers bulge as shown in FIG. 2 due to the influence of the shape of the heat-retaining glaze layer 2 lying thereunder as the base. To enhance the contact surface pressure with a printing medium, it is desirable that the printing portion is provided at the bulging portion 2*c*. Thus, the conductor layer 4 is not provided on the top of the bulging portion 2*c* as shown in FIG. 2 so that part of the resistor layer 3 is exposed and serves as heating portions 3*c*. The resistor layer 3 extends continuously from one base to the opposite base of the bulging portion 2*c* over the top of the bulging portion, but is divided at regular intervals in the longitudinal direction of the bulging portion 2*c* (FIG. 1). The conductor layer 4 includes a plurality of individual electrodes 4*a* extending from the bulging portion 2*c* in one direction and electrically connected to the output pad of a driver IC (not shown) by wire bonding, and a common electrode 4*b* provided with a plurality of comb-teeth 4*c* extending from the bulging portion 2*c* in the opposite direction from the individual electrodes 4*a*. The common electrode 4*b* is connected to a power supply circuit (not shown). By the operation of the driver IC, the individual electrodes 4*a* are selectively energized in accordance with the print data.

The resistor layer 3 and the conductor layer 4 are covered with a protective film 5. In the illustrated embodiment, the protective film 5 has a two-layer structure made up of the lower first protective layer 5*a* and the upper second protective layer 5*b*. In the present invention, another protective layer is not laminated on the second protective layer 5*b*, so that the second protective layer 5*b* is the outermost layer to directly rub against the printing medium. In this embodiment, the lower first protective layer 5*a* is mainly composed of silicon oxide and has a relatively low hardness of 500 to 800 Hk (Knoop hardness) and a thickness of 1 to 2 μm. The upper second protective layer 5*b* is mainly composed of Si—Al—O—N, SiC or SiN, and has a relatively high hardness of 1000 to 2000 Hk and a thickness of 5 to 8 μm.

A method for manufacturing a thermal printhead having the above-described structure will be described below.

First, a heat-retaining glaze layer 2 having a uniform thickness of e.g. about 80 μm is formed on a substrate 1 by forming a film by printing and then performing baking at about 1300° C. The heat-retaining glaze layer 2 is mainly composed of e.g. glass and has a heat-retention function for the resistor layer 3 to be subsequently formed on the glaze layer. Then, photo etching, for example, is performed to reduce the thickness of the glaze layer by removing the excess portion, while the portion to become the bulging portion 2*c* is left as a projection. Then, the substrate 1 is heated again so that the angular projection turns into a gently curved bulging portion 2*c*.

After the heat-retaining glaze layer 2 is formed in the above-described manner, thin films of resistor layer 3 and conductive layer 4 are successively formed by sputtering. The resistor layer 3 is formed using a resistive material such as $TaSiO_2$ to have a thickness of 500 to 1000 Å. The conductor layer 4 is formed using a conductor material such as Al as the main component to have a thickness of 0.6 to 1 μm. Then, as shown in FIG. 1, the resistor layer 3 and the conductor layer 4 are so patterned that each of the layers includes strip portions extending across the bulging portion 2*c*. In this patterning process, the conductor layer 4 is partially removed at the top of the bulging portion 2*c* so that the portions of the resistor layer 3 which are located on the bulging portion 2*c* are exposed to serve as the heating portion 3*c*. The heating portions 3*c* provided in this way on the bulging portion 2*c* can reliably come into press contact with the printing medium during the printing operation.

After the resistor layer 3 and the conductor layer 4 are formed, a lower first protective layer 5*a* for covering the heating portions 3*c* and the conductor layer 4 is made of silicon oxide as its main component by non-bias sputtering, so that its thickness will be in a range of 1 to 2 μm. The use of a relatively soft material as the main component and the choice of non-bias sputtering for film making permit the first protective layer 5*a* to have a relatively low hardness of about 500 to 800 Hk. If the thickness of the first protective layer 5*a* were less than 1 μm, pinholes would be formed due to foreign substances that may be adhering to the heating portions 3*c* of the resistor layer 3 or the conductor layer 4. This is because the amount of the film material is not sufficient, so that the material fails to get under the foreign substances. On the other hand, by making the thickness of the first protective layer 5*a* 1 μm or more, the possibility of pinhole formation is considerably reduced. The first protective layer 5*a*, as described below, serves to alleviate the stress of the harder second protective layer 5*b* to be laminated on the first layer. It should be noted, however, that a thickness of more than 2 μm is not desirable for the first layer, because that makes the first layer too pliant to support the hard second protective layer 5*b*, thereby rendering the second protective layer 5*b* susceptible to mechanical breakage.

Then, an upper second protective layer 5*b* is formed on the lower first protective layer 5*a*. Specifically, the upper second protective layer is formed using Si—Al—O—N, SiC or SiN as the main component to have a thickness of 5 to 8 μm by bias sputtering. Since negative bias is applied to the film formation target surface, i.e., the first protective layer 5*a*, $Ar^+$ ions or the like strike the surface of the first protective layer 5*a* and slightly etch away the surface of the first protective layer. Simultaneously, those ions flip away the foreign matter adhering to the surface of the first protective layer 5*a*. As a result, the adhesion of the second protective layer 5*b* to the first protective layer 5*a* is enhanced. Further, foreign matter floating in sputtering is generally charged negative by an ion sheath on the target surface. Thus, when the film formation target surface is negatively charged, the foreign matter is unlikely to adhere to the surface. In this way, by forming the second protective layer 5*b* by bias sputtering, the foreign matter entered during the film formation is removed, so that a pinhole is unlikely to be formed. Further, the film formed by bias sputtering is dense, has few film formation defects, is hard and has a high sealing performance. Thus, owing to the combination of these characteristics with its sufficient thickness of not less than 5 μm and hardness of 1000 to 2000 Hk, a scratch due to the entering of foreign matter is unlikely to be formed on the second protective layer. Further, since the relatively soft first protective layer 5*a* having an appropriate thickness exists under the second protective layer 5*b*, the stress of the second protective layer 5*b* is alleviated. Thus, the possibility that the second protective layer 5*b* is peeled off is considerably low. It is to be noted that a second protective layer 5*b* having a thickness exceeding 8 μm is not proper, because such a thick second protective layer hinders heat transfer from the heating portions 3*c* to a printing medium.

In this way, the thermal printhead according to the present invention effectively prevents the filtration of moisture or $Cl^-$ or $Na^+$ ions caused by scratches, peeling of the protective layer, film formation defects or pinholes, and the resulting rapid corrosion of the conductor layer or the resistor layer which leads to change in resistance.

The thermal printhead manufactured in the above-described manner was subjected to an accelerated reliability test in which corrosion was accelerated by immersing the surface in salt water and applying a bias. As a result, the time taken before the corrosion of the thermal printhead manufactured in the above-described manner occurred was not less than ten times the time taken before the corrosion of a thermal printhead manufactured by a conventional method occurred. Thus, it was demonstrated that the thermal printhead of the present invention had a high reliability against corrosion. A scratch acceleration test was also performed in which normal printing was performed for a certain period of time, with foreign matter placed on the upper surface of the heating portion 5*c*. In this test, in the thermal printhead manufactured by a conventional method, a change in resistance was observed at part of the heating portions. On the other hand, a change in resistance was not observed in the thermal printhead manufactured by the above-described manner.

The present invention is not limited to the foregoing embodiments, and all modifications within the scope of each of the following claims are to be included in the scope of the present invention.

The invention claimed is:

1. A thermal printhead comprising:

a glaze layer formed on an insulating substrate;

a resistor layer formed on the glaze layer;

a conductor layer formed on the resistor layer so that part of the resistor layer is exposed to serve as a heating portion; and a protective film formed to cover the conductor layer and the heating portion;

wherein the protective film comprises a lower first protective layer, and an upper second protective layer overlapping the first protective layer, the upper second protective layer being an outermost layer; and wherein the first protective layer has a hardness of 500 to 800 Hk and a thickness of 1 to 2 μm, whereas the second protective layer has a hardness of 1000 to 2000 Hk and a thickness of 5 to 8 μm, so that the first protective layer is smaller in hardness and thickness than the second protective layer.

2. The thermal printhead according to claim 1, wherein the resistor layer has a thickness of 500 to 1000 Å, whereas the conductor layer has a thickness of 0.6 to 1 μm.

3. The thermal printhead according to claim 1, wherein the glaze layer includes a bulging portion, and wherein the heating portion is positioned on the bulging portion.

4. The thermal printhead according to claim 1, wherein the first protective layer is mainly composed of silicon oxide.

5. The thermal printhead according to claim 1, wherein the second protective layer is mainly composed of a material selected from the group consisting of Si—Al—O—N, SiC and SiN.

6. A method for manufacturing a thick-film thermal printhead, the method comprising the steps of:

forming a glaze layer on an insulating substrate;

forming a resistor layer on the glaze layer by sputtering;

forming a conductor layer on the resistor layer so that part of the resistor layer is exposed to serve as a heating portion;

forming a first protective layer to cover the conductor layer and the heating portion by non-bias sputtering; and forming a second protective layer as an outermost layer on the first protective layer by bias sputtering;

wherein, in the first protective layer formation step, the first protective layer is formed to have a hardness of 500 to 800 Hk and a thickness of 1 to 2 μm, whereas, in the second protective layer formation step, the second protective layer is formed to have a hardness of 1000 to 2000 Hk and a thickness of 5 to 8 μm, so that the first protective layer is smaller in hardness and thickness than the second protective layer.

7. The method for manufacturing a thick-film thermal printhead according to claim 6, wherein, in the resistor layer formation step, the resistor layer is formed to have a thickness of 500 to 1000 Å, whereas, in the conductor layer formation step, the conductor layer is formed to have a thickness of 0.6 to 1 μm.

* * * * *